US006419814B1

(12) United States Patent
Pletcher et al.

(10) Patent No.: US 6,419,814 B1
(45) Date of Patent: Jul. 16, 2002

(54) METHODS FOR ELECTROCHEMICAL SYNTHESIS OF ORGANOIODONIUM SALTS AND DERIVATIVES

(75) Inventors: Derek Pletcher, Romsey (GB); Norman L. Weinberg, East Amherst, NY (US)

(73) Assignee: Cornell Development LLC, Reno, NV (US)

( * ) Notice: Subject to any disclaimer, the term of this patent is extended or adjusted under 35 U.S.C. 154(b) by 0 days.

(21) Appl. No.: 09/705,554

(22) Filed: Nov. 2, 2000

(51) Int. Cl.[7] ..... C25B 3/00

(52) U.S. Cl. ..... 205/463; 205/422; 205/424; 205/425; 205/456

(58) Field of Search ..... 205/422, 423, 205/424, 431, 436, 438, 444, 445, 446, 463, 456

(56) References Cited

U.S. PATENT DOCUMENTS 4,759,833 A 7/1988 Lentz et al. ..... 204/59 R
5,277,767 A * 1/1994 Cushman et al. ..... 204/59 R

OTHER PUBLICATIONS

M. R. Cushman et al, *Electrosynthesis of Diaryliodonium Salts,* 9th. International Forum on Electrolysis in the Chemical Indusrty, Sheraton Sand Key, FL, Nov. 5–9, 1995.

N.L. Weinberg et al, *Electrosynthesis of Diaryliodonium Salts,* The Electrochemical Society, Inc., Meeting Abstracts, vol. 96–1, (1220), May 5–10, 1996.

Pletcher, Derek et al, *Electrochemical Synthesis of Hypervalent Iodine Reagents*; Applied Electrochemistry for the New Millennium, Sheraton Sand Key, Clearwater Beach, FL, Nov. 7–11, 1999.

Peacock, Martin J., et al:; *Electrosynthesis of Diaryliodonium Salts*; Tetrahedron Letters 41 (2000) 8995–8998, Nov. 2000.

* cited by examiner

*Primary Examiner*—Edna Wong
(74) *Attorney, Agent, or Firm*—Howard M. Ellis

(57) ABSTRACT

Organoiodonium salts, including certain novel symmetrical and unsymmetrical diaryliodonium;. polyiodonium and cyclic iodonium salts are synthesized by a significantly improved electrochemical coupling reaction which provides greater control and selectivity over the end product produced. Reaction mixtures comprising aryliodides and/or aromatic substrates are electrolyzed in novel reaction mediums comprising strong acid electrolyte, lower carboxylic acid, and preferably in the presence of acid anhydride in amounts >10 percent by-weight, and up to 50 percent by-weight or more, to provide a high degree of product selectivity, and at yields which can even be quantitative. The methods are conducted by introducing the electrolysis reaction mixture into an undivided electrochemical cell equipped with a cathode and preferably a conductive carbon anode. A voltage is applied across the electrodes to electrolyze the reaction mixture to generate selectively mainly iodonium cation, or if desired, only aryliodide esters, at the anode.

32 Claims, No Drawings

METHODS FOR ELECTROCHEMICAL SYNTHESIS OF ORGANOIODONIUM SALTS AND DERIVATIVES

TECHNICAL FIELD

The present invention relates generally to iodonium salts, and more particularly, to high yield methods for the electrochemical synthesis of both known and novel symmetrical and unsymmetrical diaryliodonium salts, and others, such as polyiodonium salts, cyclic iodonium salts, and so on, which methods provide for greater product selectivity and improved economics.

BACKGROUND OF THE INVENTION

Diaryliodonium salts have a variety of use applications. A few representative examples include photoinitiators (U.S. Pat. Nos. 4,136,102 and 3,981,897) , fungicides (U.S. Pat. Nos. 3,944,498 and 3,763,187), bactericides (U.S. Pat. Nos. 3,885,036 and 3,712,920), many active chemicals, including pharmaceutical intermediates, and so on.

Diaryliodonium salts were first produced by the chemical route, but often relied on costly reagents. In some instances, hazardous by-products were synthesized which were unstable and potentially explosive. By contrast, electrochemical methods for synthesizing diaryliodonium salts have been found more attractive, in general. They avoid the use of highly toxic reagents, can be performed under more hazard-free conditions without forming potentially explosive by-products, and can operate at zero effluent, since chemical change is initiated by electron transfer at electrode surfaces. In addition, a redox reagent is not required in the chemistry, so process costs can be more economic.

One electrochemical process disclosed in U.S. Pat. No. 4,759,833 by Lentz et al provides for the simultaneous preparation of a diaryliodonium salt and an alkoxide salt. However, the process is conducted in a membrane divided electrolytic cell equipped with a platinum anode. While the Lentz et al process was an advance in the art, capital cost requirements for electrolytic cells so equipped can be high.

U.S. Pat. No. 5,277,767 by Cushman et al provides a further important advance in the electrochemical synthesis of diaryliodonium salts by conducting the reaction in a single compartment electrolytic cell equipped with more economical carbon anodes, like carbon felts, vitreous or glassy carbon, graphite carbon or carbon cloth. The process of Cushman et al is also based on the discovery that. anodic oxidation of an aryl iodide in the presence of an aromatic. hydrocarbon can be performed in an undivided electrolytic cell without the iodonium salts generated at the anode being reduced at the cathode. More specifically, the Cushman et al process demonstrated the electrochemical synthesis of diaryliodonium salts, such as ditolyliodonium salts wherein an unsubstituted or a substituted iodoaryl compound like iodotoluene, and an unsubstituted or substituted aromatic hydrocarbon, such as toluene are electrolyzed in a reaction medium. The medium consisted of a solvent for the iodoaryl compound, e.g., alcohols and organic acids, with acetic acid being most preferred. The reaction medium also included a supporting electrolyte, such as a strong acid, like sulfuric acid and a minor amount of a drying agent. The latter ranging from 1 to 10 percent by-weight of the reaction mixture. The drying agent could include an anhydride corresponding to the organic acid. That is, when acetic acid was used as the solvent, the preferred drying agent was acetic anhydride.

The electrochemical synthesis according to the methods of Cushman et al can be demonstrated by the following reaction:

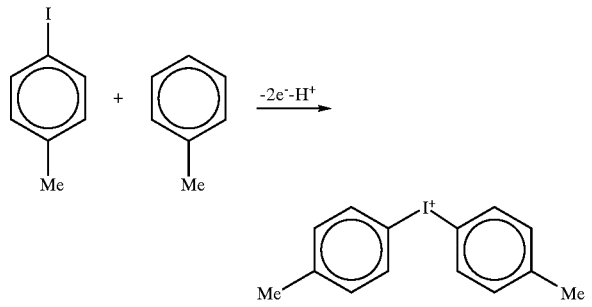

Cushman et al either failed to appreciate or concern themselves with the fact that substantial portions of the costly 4-iodotoluene reactant in this electrochemical coupling reaction were also converted to iodobenzyl carboxylate ester by-products (not shown), instead of the more valuable diaryliodonium salt.

Weinberg, et al, *Proceedings Electrochem. Soc. Spring Meeting, Abstract* 976, May, 1996 subsequently reported that 4-iodotoluene and toluene could be converted electrochemically to ditolyliodonium salts in high yields in a coupling reaction at the carbon anode in an undivided electrochemical cell in a reaction medium consisting of a mixture of acetic acid, 2 percent acetic anhydride and 5 percent sulfuric acid. In spite of this report, no attempt was made by Weinberg, et al to examine the generality of this anodic coupling procedure, the electrochemical synthesis of unsymmetrical diaryliodonium salts, and the discovery of important iodobenzyl ester by-products.

However, when the anodic oxidation of 4-iodotoluene in the presence of toluene was repeated by the immediate inventors using a carbon felt anode in the same reaction mixture of acetic acid, 2 percent acetic anhydride and 5 percent sulfuric acid it was found that the same iodonium salt was prepared, namely 4,4'-dimethyldiphenyliodonium cation. But, they also isolated in this reaction for the first time, 4-iodobenzyl acetate. Importantly, these inventors also discovered for the first time the yields of the less valuable iodobenzyl acetate by-product were practically as high as those of the more important 4,4'-dimethyldiphenyliodonium salt.

Consequently, this finding meant that the more preferred process for the electrochemical synthesis of aryliodonium salts, as practiced heretofore, had generally low product selectivity, and unfavorable economics because a very significant percentage of the costly aryliodide reactants used in the process were being expended in the generation of the less valuable by-products, e.g., iodobenzyl acetate.

Accordingly, there is a need for an improved, more economic process for the electrochemical synthesis of both symmetrical and unsymmetrical diaryliodonium salts, etc., which enables greater control over selectivity over the end-product produced, and which provides significantly higher yields than achieved heretofore.

SUMMARY OF THE INVENTION

Accordingly, it is one principal object of the invention to provide for the electrochemical synthesis of organoiodonium salts, and more particularly, to methods for the electrosynthesis of known and certain novel symmetrical and unsymmetrical diaryliodonium salts at yields not heretofore readily achievable.

It is yet a further object of the invention to provide an novel and inventive method for electrolyzing reaction mixtures comprising aryliodides and/or aromatic substrates in novel reaction mediums which impart a high degree of product selectivity in electrochemical synthesis reactions.

For purposes of this invention, the term "selectivity" or "selectivities" as appearing in this specification and appended claims is defined as the percentage of an aryliodide reactant consumed that is converted to the end product desired.

The foregoing objects can be demonstrated by the electrochemical synthesis of diaryliodonium salts of the structure:

Y-Aryl-$I^+$-Aryl'-Z, which comprises the steps of:

(i) introducing an electrolysis reaction mixture into an electrochemical cell equipped with a cathode and an electrically conductive carbon anode. The electrolysis reaction mixture comprises an aryliodide, designated by Y-Aryl-I; an aromatic substrate, designated H-Aryl'-Z and a reaction medium comprising a strong acid electrolyte; a lower carboxylic acid and an acid anhydride in an amount >10 percent by-weight, i.e., at least 11. The Aryl moiety of the aryliodide comprises at least one aromatic carbocyclic ring or aromatic heterocyclic ring structure. Y of the aryliodide reactant is at least one coupling reaction promoting substituent bonded to the Aryl moiety. The Aryl' moiety of the H-Aryl'-Z aromatic substrate comprises at least one aromatic carbocyclic ring or aromatic heterocyclic ring structure each with at least one nuclear hydrogen. Z is at least one coupling reaction promoting substituent bonded to the Aryl', and (ii) imposing a voltage across the anode and cathode of the electrochemical cell to electrolyze the electrolysis reaction mixture to provide improved selectivities of the diaryliodonium salts.

The present inventors discovered, in general, that selectivities of the more valuable diaryliodonium salts can be substantially increased according to the invention by conducting the process preferably under substantially anhydrous conditions, and particularly in a reaction medium comprising at least one acid anhydride in higher concentrations than heretofore known or suggested by other workers in the field. Through this mechanism, it was found that more of the costly aryliodide reactant, Y-Aryl-I, can selectively be made to couple with the aromatic substrate, H-Aryl'-Z, to provide greater selectivities of the more valuable diaryliodonium salts, with lesser quantities of by-product being produced. The findings of improved selectivity and yields of diaryliodonium salts were actually quite surprising in view of the electrical properties of the acid anhydrides which were present in ever increasing concentrations. The higher levels of acid anhydride in the reaction medium would be expected to lower the conductivity of the solution and to make it a less attractive medium for electrochemical syntheses. Quite surprisingly, it was found to improve the selectivity of the reaction towards diaryliodonium cations without adversely influencing other electrolysis performance factors.

The language "acid anhydride in an amount >10 percent by-weight", or variations thereof as appearing in this specification and appended claims is intended to include amounts of anhydrides greater than those taught or suggested by Cushman et al. In this regard, the prophetic portions of the disclosure of U.S. Pat. No. 5,277,767 teach the addition of acid anhydride in an amount generally in the range of "about 1% to about 10%, based on total weight of the reaction mixture, . . . " However, the actual working examples of the Cushman, et al patent suggest no more than 2.0 percent by-weight acetic anhydride. These inventors found that the reaction medium of Cushman et al, and the levels of acid anhydrides employed therein fail to provide the desired selectivity for production of commercially attractive yields of diaryliodonium salts by the electrochemical synthesis route.

Thus, while Cushman et al may suggest prophetically up to about 10 weight percent of the anhydride in their reaction medium, they fail to demonstrate an appreciation or understanding of the direct relationship of reaction medium and product selectivity as a means for regulating yields of diaryliodonium salts while suppressing production of less valuable by-products. Accordingly, even greater selectivity and higher conversion rates of the costly aryliodide reactants to the desired diaryliodonium salts can be achieved with an electrolysis reaction mixture comprising inter alia acid anhydride in amounts ranging from >10 percent by-weight, and more preferably from above about 11 to about 50 percent by-weight.

Thus, it is still a further object of the invention to provide for the electrochemical synthesis of diaryliodonium salts by a method which offers the benefits of significantly improved control over product selectivity and product yields, wherein the diaryliodonium salts have a structure:

Y-Aryl-$I^+$-Aryl'-Z, by the steps which comprise:

(i) introducing an electrolysis reaction mixture into an electrochemical cell equipped with a cathode and an electrically conductive carbon anode. The electrolysis reaction mixture comprises an aryliodide, Y-Aryl-I; an aromatic substrate, H-Aryl'-Z, in a reaction medium comprising a strong acid electrolyte; a lower carboxylic acid and an acid anhydride in an amount sufficient to produce the diaryliodonium salts at selectivities of at least 70 weight percent, when electrolyzed. The Aryl moiety of the aryliodide reactant is an aromatic ring structure selected from at least one aromatic carbocyclic ring or aromatic heterocyclic ring structure. Y is at least one coupling reaction promoting substituent bonded to the Aryl moiety. Aryl' of the H-Aryl'-Z aromatic substrate reactant is at least one aromatic carbocyclic ring or aromatic heterocyclic ring structure, each with at least one nuclear hydrogen. Z is at least one coupling reaction promoting substituent bonded to Aryl', and (ii) applying a voltage across the anode and cathode of the electrochemical cell to electrolyze the electrolysis reaction mixture to provide diaryliodonium salts with greater selectivity.

The foregoing methods also include new and useful symmetrical and unsymmetrical diaryliodonium salts and methods of manufacture. That is, the invention contemplates certain new and useful diaryliodonium salts and electrochemical synthesis methods wherein Y-Aryl and Z-Aryl' are the same (identical). Also included are unsymmetrical salts wherein Aryl and Aryl' are the same, but Y and Z groups are different, i.e. independently selected. This includes position isomers wherein Y and Z are in different positions on their respective aromatic rings. Similarly, unsymmetrical salts include species wherein Aryl and Aryl' are different, but the values for Y and Z are the same or different.

The invention also contemplates new and useful symmetrical and unsymmetrical polyiodonium salts and methods of manufacture by an electrochemical coupling mechanism at the anode. Those methods can be performed by the steps which comprise:

(i) introducing an electrolysis reaction mixture into an electrochemical cell equipped with a cathode and an electrically conductive carbon anode. The electrolysis reaction mixture comprises an arylpolyiodide, an aromatic substrate, and a reaction medium comprising at least a strong acid electrolyte and a lower carboxylic acid, with or without an acid anhydride (optional), and (ii) applying a voltage across the anode and cathode of the electrochemical cell to electrolyze the reaction mixture to provide the polyiodonium salts.

The arylpolyiodide comprises an aromatic carbocyclic ring structure or an aromatic heterocyclic ring structure, each preferably with at least two iodine atoms. The aromatic substrate comprises at least one aromatic carbocyclic or aromatic heterocyclic ring structure with at least one coupling reaction promoting substituent which may be either hydrogen, alkyl, alkoxy, aryl or aralkyl.

The foregoing methods relate to coupling procedures of multiple substrates, e.g., iodinated species and aromatic substrates wherein oxidation occurs at the anode. As previously disclosed, the coupling procedure performed in the foregoing reaction mediums have been found to be generic, and useful in preparing a wide range of both symmetrical, as well as unsymmetrical diaryliodonium salts in economically attractive selectivities. Furthermore, the reactions exhibit good regio-selectivity. The present inventors found, for instance, that coupling 4-iodotoluene and toluene employing the improved reaction mediums disclosed herein can provide a 90:10 mixture of a 4,4'-dimethylphenyliodonium and 2,4'-dimethylphenyliodonium cations.

Moreover, with aryliodides and aromatic hydrocarbons with alkyl groups larger than methyl, only the single isomer, the 4,4'-diaryliodonium cation is formed.

The improved methods of this invention for electrochemical syntheses of diaryliodonium salts at greatly improved selectivities, as previously discussed, may also be extended to syntheses of other types of iodonium salts, such as cyclic iodonium salts via intramolecular coupling mechanisms. This aspect of the invention is especially useful, for example, in forming fused ring type iodonium salts with a single reactive iodinated species.

While this embodiment can be readily demonstrated through iodinated biphenyl species, such as 2-iodobiphenyl, it is to be understood that comparable reactions can be performed as well on single ring iodinated species, such as 2-iodobenzoic acid, as will be shown in greater detail below.

Accordingly, the electrochemical synthesis methods disclosed herein are useful in making cyclic iodonium salts by the steps of:

(i) introducing an electrolysis reaction mixture into an electrochemical cell equipped with an electrically conductive carbon anode and a cathode. The electrolysis reaction mixture comprises an aryliodide, R'''-Aryl-I, and a reaction medium comprising a strong acid electrolyte, a lower carboxylic acid, and optionally an acid anhydride. The Aryl moiety of the R'''-Aryl-I comprises at least one aromatic carbocyclic ring structure or aromatic heterocyclic ring structure, each with at least one iodine atom bonded thereto. R''' is a substituent having a reactive site for formation of a cyclic iodonium salt, and is bonded to the Aryl moiety in a position ortho to the iodine atom, and (ii) a voltage is applied across the anode and cathode of the electrochemical cell to electrolyze the reaction mixture to form a cyclic iodonium salt by intramolecular coupling of the iodine atom and the R''' substituent of the same molecule.

The above reactive sites may consist of groups, such as carboxy, mercapto, amino, and so on. The reactive hetero atom site may be oxygen, sulfur or nitrogen, forming an —O—I—, —S—I—, or =N—I bond in the same cyclic iodonium salt.

As disclosed hereinabove, one important aspect of the invention relates to the discovery of how to control product selectivity and economics in the electrochemical synthesis of aryliodonium and polyiodonium salts, especially for purposes of maximizing the conversion of aryliodide reactant to such valuable products. However, it was also discovered that methods disclosed herein, likewise can also be used to selectively synthesize other iodinated species by this electrochemical route. This includes managing reactions, so that mainly iodinated products, other than the aryliodonium salts are selectively synthesized in high yields. It was found, for example, that methods of this invention can be used to maximize the production of iodinated aromatic esters, commonly generated as by-products in the electrosynthesis of aryliodonium salts, but without the co-formation of iodonium salts. That is to say, the methods of the instant invention allow for complete control over product selectivity, ranging from the synthesis iodonium salts alone to the synthesis of iodinated aromatic esters without the co-formation of iodonium salts.

Accordingly, it is still a further object of the invention to employ the novel electrochemical reaction methods of this invention for the selective preparation of iodinated species, other than iodonium salts, e.g., iodoaryl carboxylate esters by the steps of:

(i) introducing an electrolysis reaction mixture into an electrochemical cell equipped with a cathode and an electrically conductive carbon anode. The electrolysis reaction mixture comprises an aryliodide, Y-Aryl-I, and a reaction medium comprising a strong acid electrolyte, a lower carboxylic acid, and optionally an acid anhydride. The Aryl moiety of the aryliodide, Y-Aryl-I, comprises at least one aromatic carbocyclic ring or aromatic heterocyclic ring structure. Y is an alkyl or aralkyl group bonded to the Aryl moiety with each of the Y groups having at least one reactive benzylic hydrogen, and (ii) imposing a voltage across the anode and cathode of the electrochemical cell to electrolyze the electrolysis reaction mixture to provide the desired iodoaryl carboxylate esters, free of iodonium salt.

Representative examples of Y groups include methyl, ethyl, n-propyl, isopropyl or benzyl.

DESCRIPTION OF THE PREFERRED EMBODIMENTS

Methods of the invention disclosed herein are preferably conducted in simple undivided electrolytic cells. That is, the electrolysis cells are preferably free of permselective membranes, porous diaphragms, cell separators or other equivalent devices which divide the cell into separate anode and cathode compartments. Instead, the electrolytic cells of this invention are fitted with one or more anodes and cathodes in a single or common compartment. Cells so equipped are more economic in terms of capital costs to purchase and also to operate. Divided electrolytic cells normally consume more power than undivided cells due to higher IR loss.

Electrical connection maybe either monopolar or bipolar. Preferred electrode materials include mainly electrically conductive carbons for the anodes. The main criteria is the electrodes have low capital cost and operate at high current efficiencies. Representative examples of useful carbons are carbon felts, vitreous or glassy carbon, reticulated vitreous carbons, graphitic carbon, carbon cloth, and so on.

Cathode materials may also be comprised of materials like those disclosed above for use in anodes. However, in the case of cathodes, a broader range of materials may be used. Practically any of the known electrode materials capable of providing high operating current efficiencies for hydrogen evolution may be employed. Representative examples include steel, lead, silver, nickel, copper, tin, various alloys, including precious metals, such as platinum, to name but a few.

In the electrochemical synthesis of diaryliodonium salts, the reaction requires coupling of an aryliodide compound, Y-Aryl-I, and an aromatic substrate, H-Aryl'-Z. For a given diaryliodonium salt, Aryl and Aryl', as well as Y and Z substituents may be the same or different. As previously disclosed, when both aromatic ring structures, Aryl and Aryl', and their respective substituents Y and Z are the same, then the diaryliodonium cations and their respective salts are symmetrical. Similarly, when either of the aromatic ring structures, Aryl and Aryl', and/or their respective substituents, Y and Z, are different the diaryliodonium salts produced according to this invention are unsymmetrical.

Aryl and Aryl' may each comprise one or more aromatic ring structures. That is, the aromatic rings of the aryliodides, Y-Aryl-I and the aromatic substrates, H-Aryl'-Z, may be either a single aromatic ring structure, e.g., phenyl, or multiple, non-fused rings, e.g., biphenyl. Similarly, the aromatic carbocyclic ring structures of this invention can also be fused structures, e.g., naphthyl, phenanthryl or anthryl rings.

Likewise, Aryl and Aryl' of the aryliodide, Y-Aryl-I, and the aromatic substrate, H-Aryl'-Z, can comprise one or more aromatic heterocyclic ring structures, typically 5 and 6 member rings wherein one or more of the atoms of the ring structures are elements other than carbon, e.g., . . . nitrogen, sulfur and/or oxygen. This would include such representative examples as pyridyl; furyl; and thienyl. This would also include 5 and 6 member rings with mixed hetero atoms, like oxazolyl, thiazolyl, and so on. In addition, the invention contemplates fused aromatic heterocyclic ring structures like quinolyl and indolyl.

The expression "coupling reaction promoting substituent" as appearing in the specification and claims refers to the Y and Z groups bonded to the aromatic ring structures, previously discussed. One possible explanation for the coupling reaction mechanism is anodic substitution wherein the aryliodide, Y-Aryl-I, gives up an electron to form a cation radical (not shown) . The aromatic substrate, H-Aryl'-Z, a nucleophile traps the cation radical. While the ring position for the coupling reaction is largely dependent on electronic and steric effects, the reaction which is highly regiospecific greatly favors para-para diaryliodonium salts over others, e.g., ortho-para products. Generally, the electron donating "coupling reaction promoting substituents" are alkyl, alkoxy, aryl and aralkyl. Alkyl is usually a lower radical in the range of 1 to 6 carbon atoms which would include such groups as methyl, ethyl, propyl, isopropyl, t-butyl, etc., however, longer chain alkyl groups can be employed. Alkoxy usually comprises lower radicals, such as methoxy, ethoxy and propoxy. Aryl and aralkyl are aromatic rings structures like phenyl and alkylphenyl. This is inclusive of aromatic heterocyclic ring structures, like those discussed above in connection with the aryliodides and aromatic substrates. This would also include substituted heterocyclic structures e.g., methylthiophene. This would especially include aromatic hydrocarbon ring structures like phenyl, tolyl; biphenyl, and so on.

The electrochemical synthesis reaction of the invention is performed in an anhydrous medium, one which is free or essentially-free of water, although trace and even small or minor amounts of moisture may be present. Compositionally, the medium comprises a strong acid electrolyte; a lower carboxylic acid and usually an acid anhydride. The expression "strong acid electrolyte" as appearing in the specification and claims is intended to mean mineral acids which are inorganic acids, such as sulfuric acid. Another example of a strong acid electrolyte is fluoroboric acid. Other suitable strong acid electrolytes include the non-carboxylic organic acids like methanesulfonic acid and trifluoromethylsulfonic acid, and so on. Concentrated acids are preferred. The strong acid electrolyte is employed in the reaction medium in concentrations sufficient to impart needed conductivity. This includes concentrations ranging generally from about 2 to about 20 percent by-weight, and more preferably, in concentrations ranging from about 5 to about 10 percent by-weight.

The reaction medium also comprises a carboxylic acid, which is different from the previously disclosed "strong acid electrolyte", the latter being exclusive of carboxylic acids. The carboxylic acid is an organic acid, preferably a lower carboxylic acid which for purposes of this invention is intended to mean organic carboxylic acids having from 1 to about 5 carbon atoms, e.g. formic acid, acetic acid, propionic acid, and so on. When the carboxylic acid is, for instance, acetic acid a concentrated acid, like glacial acetic acid having a purity of 99 percent or more, is preferred. The carboxylic acid is employed in the reaction medium in concentrations ranging generally from about 20 to about 90% by-volume, and more preferably, in concentrations ranging from about 30 to about 80% by-volume.

A further component of the reaction medium is the acid anhydride which was found to have a significant effect in regulating product selectivity and in maximizing conversion of aryliodides electrochemically to many of the iodonium salts of this invention. Generally, the particular acid anhydride employed in the reaction medium will correspond to the lower carboxylic acid, however, this is not a requirement. Nevertheless, when the lower carboxylic acid is acetic acid, for example, the acid anhydride will usually be acetic anhydride.

In the electrochemical synthesis of diaryliodonium salts in particular, the higher concentration of acid anhydride present in the reaction medium appears to perform an important roll in achieving higher selectivities of the iodonium salts. The concentration of acid anhydride is >10 weight-percent, usually from a lower range of about 11 or 12 weight-percent to 15 and up to about 50 weight-percent, or more to maximize the selectivity and conversion of aryliodides to their respective iodonium cations. More specifically, the acid anhydride is employed in amounts ranging from about 20 to about 40 weight percent, or higher to provide yields of at least 70 percent, and higher, i.e., 90 percent.

Selectivities of the organoiodonium salts according to the methods of this invention may even be quantitative.

The diaryliodonium cations are readily converted to their corresponding salts by methods well known among those of ordinary skill in the art. Representative examples of useful salts include carbonate, halide, nitrate, phosphate, sulfate, bisulfate, carboxylate, tetrafluoroborate, hexafluorophosphate, hexafluoroantimonate, to name but a few. Salts can also be made with negatively charged polymers, such as anion exchange resins. They include the well known resins having carboxylic acid or sulfonic acid moieties, perfluorosulfonic acid resins, e.g., Nafion, a trademark of E.I. DuPont, and so on.

In addition to the diaryliodonium salts with a single iodonium cation, the invention also includes polyiodonium salts having a plurality of iodonium cations, at least 2, and more specifically, from 2 to 4 iodonium cations. The polyiodonium salts prepared according to the methods of this invention are useful as insoluble reagents, in non-fouling coatings and as biocides. Representative examples of useful polyiodonium salts include those of the general formula:

$$R\text{-Aryl-}(I^{+}\text{-Aryl''})_{x}\text{-Aryl'-R'}$$

wherein x is from 2 to 4. R-Aryl and R'-Aryl' may be the same or different R and R' are coupling reaction promoting substituents bonded to the aromatic moieties, Aryl and Aryl', and can include hydrogen, alkyl, alkoxy, aryl or aralkyl. Aryl and Aryl' are each comprised of at least one aromatic ring, i.e., aromatic carbocyclic and aromatic heterocyclic ring structures, as previously defined. Aryliodonium cation structures designated as Aryl"-$I^{+}$ comprise at least one aromatic carbocyclic ring or aromatic heterocyclic ring structure with at least 2 iodonium cations.

One representative example of an electrosynthesis reaction in forming a polyiodonium salt can also be demonstrated by the following:

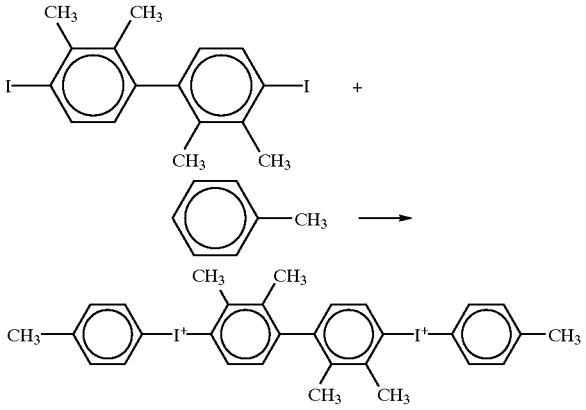

A further representative example of polyiodonium salts which may be prepared according to the method of this invention is:

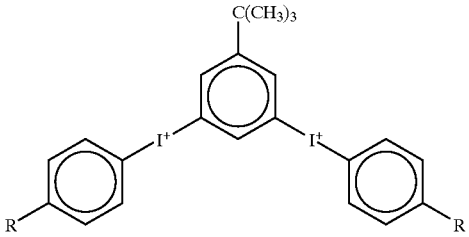

wherein R=alkyl, alkoxy, aryl, aralkyl

Salts of the above polyiodonium cations are prepared by methods known among persons skilled in the art. Specific representative examples of useful salts include carbonate, halide, nitrate, phosphate, sulfate, bisulfate, carboxylate, tetrafluoroborate, hexafluorophosphate, hexafluoroantimonate, etc.

The salts of this invention may also be represented by 5 and 6 membered cyclic iodonium salts and their derivatives, such as:

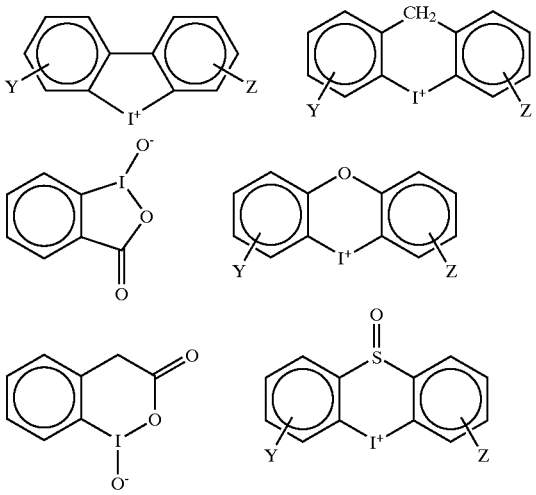

Y and Z are independently selected from the group consisting of hydrogen, alkyl, alkoxy or aryl. The above salts are useful, for example, reactants in the synthesis of organic chemicals and as biocides.

As previously disclosed, the invention includes methods for the electrochemical synthesis of carboxylate esters. The esters are useful as reagents in the synthesis of pharmaceuticals and other valuable compounds. One representative group of useful esters are the iodoaryl carboxylate esters represented by the following formula:

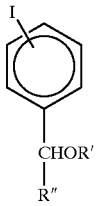

wherein R" is $CH_3(—CH_2—)_n$ where n=1 to 4 and R' is $O{=}C—(CH_2)_x—CH_3$, and x=0 to 3

EXAMPLE 1

In order to demonstrate the influence of acid anhydride content of an electrolysis medium on products formed in the electrolysis of 4-iodotoluene (0.2M) and toluene (0.3M) at a carbon felt anode the following experiments were performed:

An electrolysis cell was set-up based on a 250 $cm^3$ beaker. A sheet of carbon felt (dimensions 200 mm×40 mm, thickness 15 mm) was formed into a cylindrical anode around the perimeter of the beaker. A graphite rod cathode was placed at the center of the beaker so there was a uniform gap between the two electrodes. The electrolyte was 100 $cm^3$ of a solution containing 4-iodotoluene iodide (0.02 moles) and toluene (0.03 moles) in acetic acid/2%; 10% and 25% acetic anhydride/5% sulfuric acid. During the electrolyses, the solution was stirred with a magnetic stirrer bar. A constant current of 0.4 A, was passed until a charge equivalent to 1.6 F (80% theoretical charge for the complete conversion of the aryl iodide. The consumption of reactants and the formation of product were followed by hplc. At the termination of the electrolyses, the electrodes were washed well with hot methanol and the washings combined with the reaction mixture. The solvents were removed in vacuo and the resulting oil was dissolved in diethyl ether. The dimethyldiphenyliodonium bisulfate was extracted into water and the corresponding iodide was precipitated by the addition of KI. The solid 4,4'-dimethyldiphenyliodonium iodide was dried and weighed (5 g of the iodide salt was obtained). The product was characterized by $^1H$ and $^{13}C$ NMR and mass spectroscopy.

TABLE 1

| Acetic Anhydride (%) | Selectivity (%) iodonium salt | Selectivity (%) Iodobenzyl Acetate |
|---|---|---|
| 2 | 46 | 40 |
| 10 | 66 | 23 |
| 25 | 92 | 6 |

Table 1 demonstrates the considerable influence of higher acetic anhydride concentrations in providing higher selectivities of the important iodonium salts and reduced selectivities of iodobenzyl acetate.

EXAMPLE 2

The electrolysis cell was based on a 250 $cm^3$ beaker. A sheet of carbon felt (dimensions 200 mm×40 mm, thickness 15 mm) was formed into a cylindrical anode around the perimeter of the beaker and a graphite rod cathode was placed at the center of the beaker so that there was a uniform gap between the two electrodes. The electrolyte was 100 $cm^3$ of a solution containing iodotoluene (0.02 moles) and toluene (0.03 moles) in acetic acid/25% acetic anhydride/5% sulfuric acid. During the electrolysis, the solution was stirred with a magnetic stirrer bar. A constant current of 0.4 A, was passed until a charge equivalent to 1.6 F(80% theoretical charge for the complete conversion of the aryl iodide). The consumption of reactants and the formation of product were followed by hplc. The hplc selectivity for the 4,4'-ditolyliodonium salt was 90%. It was possible to isolate the diaryliodonium salt as the bisulfate, a white solid being formed on addition of diethyl ether directly to the electrolysis solution. Pure white crystals were obtained. The 4,4'-dimethyldiphenyliodonium bisulfate was characterized by $^1H$ and $^{13}C$ NMR and mass spectroscopy.

EXAMPLE 3

The electrolysis cell was based on a 250 $cm^3$ beaker. A sheet of carbon felt (dimensions 200 mm×40 mm, thickness 15 mm) was formed into a cylindrical anode around the perimeter of the beaker. A graphite rod cathode was placed at the center of the beaker so there was a uniform gap between the two electrodes. The electrolyte was usually 100 $cm^3$ of a solution containing an aryl iodide(0.02 moles) and arene (0.03 moles) in acetic acid/2%; 10% and 25% acetic anhydride/5% sulfuric acid. During the electrolyses, the solution was stirred with a magnetic stirrer bar. A constant current of 0.4 A, was passed until a charge equivalent to 1.6 F(80% theoretical charge for the complete conversion of the aryl iodide). The consumption of reactants and the formation of product were followed by hplc. At the termination of electrolyses, the electrodes were washed well with hot methanol and the washings combined with the reaction mixture. The solvents were removed in vacuo and the resulting oil dissolved in diethyl ether. The solid diaryliodonium bisulfate salt was extracted into water and the corresponding iodide was precipitated by the addition of KI. The solid diphenyliodonium iodide was dried and weighed. The product was characterized by $^1H$ and $^{13}C$ NMR and mass spectroscopy.

Table 2 is a record of the selectivities and current efficiencies of the diaryliodonium salts, isolated as iodide salts, by the electrolysis of aryliodide (0.2M) plus arene (0.3M) at a carbon felt anode in acetic acid/25% acetic anhydride/5% $H_2SO_4$ at a current density of 5 $mAcm^{-2}$. The importance of various alkyl "coupling reaction promoting substituents" is demonstrated, including methyl, ethyl, isopropyl, and t-butyl, compared to hydrogen. An electron donating group is required in the arene to enable formation of significant diaryliodonium product.

TABLE 2

| Y | Z | Selectivity/% | Current efficiency/% |
|---|---|---|---|
| 4-$CH_3$ | 4-$CH_3$ | 92 | 46 |
| 3-$CH_3$ | 4-$CH_3$ | 83 | 27 |
| 2-$CH_3$ | 4-$CH_3$ | 77 | 37 |
| 4-$CH_3$ | 4-$C_2H_5$ | 71 | 22 |
| 4-$CH_3$ | 4-$CH(CH_3)_2$ | 78 | 22 |
| 4-$CH_3$ | 4-$C(CH_3)_3$ | 92 | 44 |
| 4-$C(CH_3)_3$ | 4-$CH_3$ | 48 | 14 |
| 4-$C(CH_3)_3$ | 4-$C(CH_3)_3$ | 52 | 31 |
| 4-$CH_3$ | H | trace | — |
| H | 4-$CH_3$ | 78 | 20 |
| H | H | trace | — |

EXAMPLE 4

The following example demonstrates the formation of a cyclic iodonium salt by intramolecular reaction. The electrolysis cell was based on a 250 $cm^3$ beaker. A sheet of carbon felt (dimensions 200 mm×40 mm, thickness 15 mm) was formed into a cylindrical anode around the perimeter of the beaker and a graphite rod cathode was placed at the centre of the beaker so that there was a uniform gap between the two electrodes. The electrolyte was usually 100 $cm^3$ of a solution containing 2-iodobiphenyl (0.02 moles) in acetic acid/25% acetic anhydride/5 % sulfuric acid. During the electrolysis, the solution was stirred with a magnetic stirrer bar. A constant current of 0.4 A, was passed until a charge equivalent to 1.6 F (80% theoretical charge for the complete conversion of the iodoaromatic compound). The consumption of reactants and the formation of product were followed by hplc. At the termination of the electrolyses, the electrodes were washed well with hot methanol and the washings combined with the reaction mixture. The solvents were removed in vacuo and the resulting oil was dissolved in diethyl ether. The dibenzyliodonium cation was precipitated as the iodide salt by the addition of excess KI. The yield and selectivity were 75%. The dibenzyliodonium iodide was characterised by $^{1}H$ and $^{3}C$ NMR and mass spectroscopy.

EXAMPLE 5

The following example demonstrates the formation of a cyclic iodonium salt containing an additional hetero atom in the iodonium salt ring, forming an I—O bond, by intramolecular reaction with an ortho-substituted carboxylic acid. The electrolysis cell was based on a 250 $cm^3$ beaker. A sheet of carbon felt (dimensions 200 mm×40 mm, thickness 15 mm) was formed into a cylindrical anode around the perimeter of the beaker and a graphite rod cathode was placed at the centre of the beaker so that there was a uniform gap between the two electrodes. The electrolyte was 100 $cm^3$ of a solution containing 2-iodobenzoic acid (0.02 moles) in acetic acid/25% acetic anhydride/5% sulfuric acid. During the electrolysis, the solution was stirred with a magnetic stirrer bar. A constant current of 0.4 A, was passed until a charge equivalent to 6 F. The consumption of reactants and the formation of product were followed by hplc. At the termination of the electrolyses, the electrolyte was diluted with 300 $cm^3$ of diethyl ether and 100 $cm^3$ of 1 M sodium hydroxide. After leaving overnight, a precipitate was filtered off. The solid was shown by $^{1}H$ and $^{13}C$ NMR and mass spectroscopy to be 2-iodosylbenzoic acid. The selectivity was 95%. This product is a reagent in chemical synthesis and cleavage of proteins, and is a precursor of the valuable Dess Martin reagent.

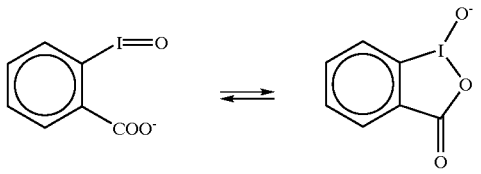

EXAMPLE 6

The following example demonstrates the formation of a polyiodonium salt, having two iodonium centers in the molecule. An undivided plate and frame type flow cell, the MP Cell manufactured by ElectroCell, Sweden is used, having electrodes of graphite, each 100 cm2 in area. The cell is connected to a pump, power supply, flow meter and solution reservoir, containing 2 liters of a solution consisting of glacial acetic acid, 15% by weight acetic anhydride, 5% by weight tetrafluoroboric acid (50% $HBF_4$), 20 grams (0.05 moles) 4,4'-diiodobiphenyl and 30 grams toluene. The electrolyte solution at ambient temperature is recirculated through the cell while electrolysis is conducted at an anode current density of 20 $mA/cm^2$. After passage of 11 Ahours of charge, a twofold excess theoretically needed to form two iodonium sites, the electrolysis is stopped. The solution containing the product is distilled under reduced pressure and temperature to remove solvent. The resulting oil is dissolved in diethyl ether. The 4,4'-ditolyldiiodoniumbiphenyl cation is precipitated as the iodide salt by the addition of excess aqueous KI.

While the invention has been described in conjunction with specific examples thereof, they are illustrative only. Accordingly, many alternatives, modifications and variations will be apparent to persons skilled in the art in light of the foregoing description, and it is therefore intended to embrace all such alternatives and modifications as to fall within the spirit and broad scope of the appended claims.

We claim:

1. A method for making diaryliodonium salts of the structure:

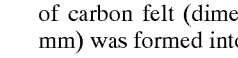

which comprises the steps of:

(i) introducing an electrolysis reaction mixture into an electrochemical cell equipped with a cathode and an electrically conductive carbon anode, said electrolysis reaction mixture comprising an aryliodide, Y-Aryl-I; an aromatic substrate, H-Aryl'-Z and a reaction medium comprising a strong acid electrolyte; a lower carboxylic acid and an acid anhydride in an amount ranging from about 15 to about 50 percent by-weight, said Aryl of said Y-Aryl-I comprising at least one aromatic carbocyclic ring or heterocyclic ring structure and Y is at least one coupling reaction promoting substituent bonded to said Aryl, said Aryl' of said H-Aryl'-Z comprising at least one aromatic carbocyclic ring or heterocyclic ring structure each with at least one nuclear hydrogen and Z is at least one coupling reaction promoting substituent bonded to said Aryl', and (ii) imposing a voltage across said anode and cathode of said electrochemical cell to electrolyze said electrolysis reaction mixture to provide improved yields of said diaryliodonium salts.

2. The method of claim 1 performed under anhydrous conditions.

3. The method of claim 1 wherein the lower carboxylic acid is acetic acid and the acid anhydride is acetic anhydride.

4. The method of claim 1 wherein Y is hydrogen, alkyl, alkoxy, aryl or aralkyl, and Z is alkyl, alkoxy, aryl or aralkyl.

5. The method of claim 1 wherein both Aryl and Aryl' are phenyl, naphthyl, phenanthryl or anthryl and Y and Z are the same forming a symmetrical diaryliodonium salt.

6. The method of claim 5 wherein Y is hydrogen, alkyl, alkoxy, aryl or aralkyl, and Z is hydrogen, alkyl, alkoxy, aryl or aralkyl.

7. The method of claim 5 wherein Y and Z are methyl, ethyl, n-propyl, isopropyl or t-butyl.

8. The method of claim 1 wherein the strong acid electrolyte is tetrafluoroboric acid.

9. The method of claim 1 wherein both Aryl and Aryl' are aromatic rings independently selected from the group consisting of phenyl, naphthyl, phenanthryl and anthryl, and from heterocyclic aromatic ring structures having at least one hetero atom selected from the group consisting of sulfur, oxygen and nitrogen, and wherein Y and Z are different forming an unsymmetrical diaryliodonium salt.

10. The method of claim 9 wherein Y and Z of the unsymmetrical diaryliodonium salt are independently selected from the group consisting of hydrogen, alkyl, alkoxy, aryl or aralkyl.

11. The method of claim 10 wherein Y and Z are methyl, ethyl, n-propyl, isopropyl or t-butyl.

12. The method of claim 1, including the step of isolating an iodonium salt selected from the group consisting of carbonate, halide, nitrate, phosphate, sulfate, bisulfate, carboxylate, tetrafluoroborate, hexafluorophosphate, hexafluoroantimonate and a salt of an anionic polymer.

13. The method of claim 12, wherein the carboxylate is an acetate salt.

14. A method for making diaryliodonium salts of the structure:

Y-Aryl-I$^+$-Aryl'-Z, which comprises the steps of:

(i) introducing an electrolysis reaction mixture into an electrochemical cell equipped with a cathode and an electrically conductive carbon anode, said electrolysis reaction mixture comprising an aryliodide, Y-Aryl-I; an aromatic substrate, H-Aryl'-Z and a reaction medium comprising a strong acid electrolyte, a lower carboxylic acid and an acid anhydride in an amount sufficient to produce the diaryliodonium salts at selectivities of at least 70 percent when electrolyzed, the Aryl of said Y-Aryl-I comprising at least one aromatic carbocyclic ring or heterocyclic ring structure and Y is at least one coupling reaction promoting substituent bonded to said Aryl, said Aryl' of said H-Aryl'-Z comprising at least one aromatic carbocyclic ring or heterocyclic ring structure, each with at least one nuclear hydrogen and Z is at least one coupling reaction promoting substituent bonded to said Aryl', and (ii) imposing a voltage across said anode and cathode of said electrochemical cell to electrolyze said electrolysis reaction mixture to provide said diaryliodonium salts.

15. The method of claim 14 wherein the aryliodide, Y-Aryl-I, is an iodophenyl wherein Y is hydrogen or alkyl, the aromatic substrate, H-Aryl'-Z, is phenyl wherein Z is alkyl, the strong acid is a mineral acid, the lower carboxylic acid is acetic acid, and the acid anhydride is acetic anhydride present in amounts ranging from about 12 to about 40 percent by-weight.

16. The method of claim 14 performed under anhydrous conditions.

17. The method of claim 14 wherein the lower carboxylic acid is acetic acid and the acid anhydride is acetic anhydride present in an amount sufficient to provide diaryliodonium salts at yields ranging from about 70 percent to approximately quantitative yields.

18. The method of claim 17 wherein Y is hydrogen, alkyl, alkoxy, aryl or aralkyl, and Z is alkyl, alkoxy, aryl or aralkyl.

19. The method of claim 14 wherein both Aryl and Aryl' are independently selected from aromatic rings from the group consisting of phenyl, naphthyl, phenanthryl, anthryl, and from heterocyclic aromatic ring structures having at least one hetero atom selected from the group consisting of sulfur, oxygen and nitrogen, and wherein Y and Z are hydrogen, alkyl, alkoxy, aryl or aralkyl.

20. The method of claim 19 wherein Y and Z are methyl, ethyl, n-propyl, isopropyl or t-butyl.

21. The method of claim 14, including the step of isolating an iodonium salt selected from the group consisting of carbonate, halide, nitrate, phosphate, sulfate, bisulfate, carboxylate, tetrafluoroborate, hexafluorophosphate, hexafluoroantimonate and a salt of an anionic polymer.

22. A method for electrochemical synthesis of polyiodonium salts, which comprises the steps of:

(i) introducing an electrolysis reaction mixture into an electrochemical cell equipped with a cathode and an electrically conductive carbon anode, said electrolysis reaction mixture comprising an arylpolyiodide, an aromatic substrate, and a reaction medium comprising a strong acid electrolyte and a lower carboxylic acid; and (ii) imposing a voltage across said anode and cathode of said electrochemical cell to electrolyze said reaction mixture to provide a polyiodonium salt.

23. The method of claim 22 wherein the arylpolyiodide comprises an aromatic carbocyclic ring or aromatic heterocyclic ring, each with at least 2 iodine atoms, and the aromatic substrate comprises at least one aromatic carbocyclic or aromatic heterocyclic ring structure with at least one coupling reaction promoting substituent.

24. The method of claim 23 wherein the coupling reaction promoting substituent is alkyl, alkoxy, aryl or aralkyl.

25. The method of claim 23 wherein the reaction medium includes an acid anhydride.

26. A method for electrochemical synthesis of cyclic iodonium salts and derivatives, which comprises the steps of:

(i) introducing an electrolysis reaction mixture into an electrochemical cell equipped with an electrically conductive carbon anode and a cathode, said electrolysis reaction mixture comprising an aryliodide, R'''-Aryl-I, and a reaction medium comprising a strong acid electrolyte and a lower carboxylic acid, the Aryl moiety of said R'''-Aryl-I comprising at least one carbocyclic aromatic ring structure or heterocyclic aromatic ring structure, each with at least one iodine atom bonded thereto; R''' is a substituent having a reactive site for formation of a cyclic iodonium salt, said substituent bonded to said Aryl moiety in a position ortho to said iodine atom, and (ii) imposing a voltage across said anode and cathode of said electrochemical cell to electrolyze said reaction mixture to form a cyclic iodonium salt by intramolecular coupling of the iodine atom and said R''' substituent of the same molecule.

27. The method of claim 26 wherein the Aryl moiety of said R'''-Aryl-I has a reactive hetero atom site on the same ring structure as the iodine atom.

28. The method of claim 27 wherein the reactive hetero atom site is oxygen, sulfur or nitrogen, forming an —O—I—, —S—I—, or ═N—I-bond in the same cyclic iodonium salt.

29. The method of claim 27 wherein the reaction medium includes an acid anhydride.

30. A method for electrochemical synthesis of iodoaryl carboxylate esters by the steps which comprise:

(i) introducing an electrolysis reaction mixture into an. electrochemical cell equipped with a cathode and an electrically conductive carbon anode, said electrolysis reaction mixture comprising an aryliodide, Y-Aryl-I, and a reaction medium comprising a strong acid electrolyte, a lower carboxylic acid and an acid anhydride, the Aryl moiety of said Y-Aryl-I comprising at least one aromatic carbocyclic ring or aromatic heterocyclic ring structure and Y is an alkyl or aralkyl group bonded to said Aryl moiety with each of said groups having at least one reactive benzylic hydrogen, and (ii) imposing a voltage across said anode and cathode of said electrochemical cell to electrolyze said electrolysis reaction mixture to provide the iodoaryl carboxylate esters.

31. The method of claim 30 wherein Y is methyl, ethyl, n-propyl, isopropyl or benzyl.

32. A method for making diaryliodonium salts of the structure:

Y-Aryl-I$^+$-Aryl'-Z, which comprises the steps of:

(i) introducing an electrolysis reaction mixture into an electrochemical cell equipped with a cathode and an electrically conductive carbon anode, said electrolysis reaction mixture comprising an aryliodide, Y-Aryl-I; an aromatic substrate, H-Aryl'-Z and a reaction medium comprising a strong acid electrolyte; a lower carboxylic acid and an acid anhydride in an amount >10 percent by-weight to produce the diaryliodonium salts at selectivities of at least 70 percent when electrolyzed, said Aryl of said Y-Aryl-I comprising at least one aromatic carbocyclic ring or heterocyclic ring structure and Y is at least one coupling reaction promoting substituent bonded to said Aryl, said Aryl' of said H-Aryl'-Z comprising at least one aromatic carbocyclic ring or heterocyclic ring structure each with at least one nuclear hydrogen and Z is at least one coupling reaction promoting substituent bonded to said Aryl', and (ii) imposing a voltage across said anode and cathode of said electrochemical cell to electrolyze said electrolysis reaction mixture to provide improved yields of said diaryliodonium salts.

* * * * *